US007789127B2

(12) United States Patent
Lu et al.

(10) Patent No.: US 7,789,127 B2
(45) Date of Patent: Sep. 7, 2010

(54) HEAT TRANSFER TUBES FOR EVAPORATORS

(75) Inventors: Minghua Lu, Changshu (CN); Chunming Zhang, Chnagshu (CN); Xiaoyu Cui, Shanghai (CN); Xing Luo, Shanghai (CN); Hugen Ma, Shanghai (CN)

(73) Assignees: Jiangsu Cuilong Precision Copper Tube Corporation, Jiangsu Province (CN); University of Shanghai for Science and Technology, Shanghai (CN)

( * ) Notice: Subject to any disclaimer, the term of this patent is extended or adjusted under 35 U.S.C. 154(b) by 882 days.

(21) Appl. No.: 11/429,710

(22) Filed: May 8, 2006

(65) Prior Publication Data

US 2007/0034361 A1 Feb. 15, 2007

(30) Foreign Application Priority Data

Aug. 9, 2005 (CN) ..... 2005 1 0041468

(51) Int. Cl.
*F28F 13/18* (2006.01)
*F28F 1/20* (2006.01)

(52) U.S. Cl. ..... 165/133; 165/181; 165/184; 29/890.053

(58) Field of Classification Search ..... 165/133, 165/181, 184; 29/890.053
See application file for complete search history.

(56) References Cited

U.S. PATENT DOCUMENTS 3,202,212 A * 8/1965 Kritzer ..... 165/181
3,753,364 A * 8/1973 Runyan et al. ..... 165/184
3,881,342 A * 5/1975 Thorne ..... 165/133
4,060,125 A * 11/1977 Fujie et al. ..... 165/133
4,179,911 A * 12/1979 Saier et al. ..... 165/184
4,438,807 A * 3/1984 Mathur et al. ..... 165/133
4,602,681 A * 7/1986 Daikoku et al. ..... 165/133
4,606,405 A * 8/1986 Nakayama et al. ..... 165/133
4,660,630 A * 4/1987 Cunningham et al. ..... 165/133
4,678,029 A * 7/1987 Sasaki et al. ..... 165/133
4,729,155 A * 3/1988 Cunningham et al. ..... 165/179

(Continued)

FOREIGN PATENT DOCUMENTS

CN 94116309.1 3/1995

(Continued)

*Primary Examiner*—Ljiljana (Lil) V Ciric
(74) *Attorney, Agent, or Firm*—Dickstein Shapiro LLP

(57) ABSTRACT

Heat transfer tubes for evaporators in air conditioning and refrigeration systems, each tube including: a tube body (1); outer fins (2) extending on an outer wall surface of the tube body (1) and having outer fin walls opposite to the outer fin walls of the adjacent outer fins; channels (6) located between the adjacent fins (2) so as to constitute channel chambers; fin top platforms (3) on respective tops of the outer fins (2), the fin top platforms (3) including fin top edges (3*a*) extending from both sides of the fin top platforms (3) so that the channel chambers form a cavity structure as a whole; channel chamber openings constituted by gaps between the adjacent fin top edges (3*a*) of the fin top platforms (3) of the outer fins; and lateral fins (4) arranged on portions or substantially middle portions of the outer fin walls of the outer fins (2) in a height direction of the outer fins (2) and at intervals in an spreading direction of the outer fins (2), so that the cavity structure is formed into a double cavity structure.

13 Claims, 4 Drawing Sheets

U.S. PATENT DOCUMENTS

| | | | | | |
|---|---|---|---|---|---|
| 4,747,448 | A | * | 5/1988 | Beduz et al. | 165/133 |
| 5,054,548 | A | * | 10/1991 | Zohler | 165/133 |
| 5,186,252 | A | * | 2/1993 | Nishizawa et al. | 165/133 |
| 5,203,404 | A | * | 4/1993 | Chiang et al. | 165/133 |
| 5,351,397 | A | * | 10/1994 | Angeli | 29/890.053 |
| 5,697,430 | A | * | 12/1997 | Thors et al. | 165/184 |
| 5,775,411 | A | * | 7/1998 | Schuez et al. | 165/133 |
| 5,832,995 | A | * | 11/1998 | Chiang et al. | 165/184 |
| 6,913,073 | B2 | | 7/2005 | Beutler et al. | |
| 7,178,361 | B2 | * | 2/2007 | Thors et al. | 165/184 |
| 7,254,964 | B2 | * | 8/2007 | Thors et al. | 165/184 |
| 2004/0010913 | A1 | | 1/2004 | Thors et al. | |

FOREIGN PATENT DOCUMENTS

| | | | |
|---|---|---|---|
| CN | 2257376 | Y | 7/1997 |
| CN | 1366170 | A | 8/2002 |
| CN | 1090750 | C | 9/2002 |
| CN | 2557913 | Y | 6/2003 |
| CN | 2572324 | Y | 9/2003 |
| CN | 2662187 | Y | 12/2004 |

* cited by examiner

HEAT TRANSFER TUBES FOR EVAPORATORS

BACKGROUND OF THE INVENTION

1. Field of the Invention

The present invention relates generally to heat transfer tubes for evaporators in air conditioning and refrigeration systems, more particularly, to a heat transfer tube that has an outer wall surface formed therein with double cavity.

2. Description of the Related Art

Many fields, such as refrigeration, air conditioning, process engineering, petrochemical processing, and energy source and power engineering, relate to evaporating and boiling of a liquid on an outer wall surface of a tube. Especially in evaporators used in air conditioning and refrigeration systems, a thermal resistance of boiling heat transfer in the case that a refrigerant is boiling on an outer wall surface of a tube corresponds substantially to and even larger than that of the forced convection in the tube. Therefore, it can significantly improve the heat transfer performance of the evaporator to enhance the boiling heat transfer on the outer wall surface of the tube.

It was found from the study on the mechanism of the nucleate boiling that the boiling of a liquid requires the existence of nucleation sites for evaporating. For a heating surface with a given superheating temperature, only when a radius of a nucleation site for evaporating is larger than a minimum radius required for the growing of a vapor bubble, the vapor bubble can grow up so that the nucleate boiling process can be performed. Cavities formed from grooves and cracks in the heating surface most probably become nucleation sites for evaporating. During boiling, after the vapor bubbles grow up and break away from the cavities, as it is difficult for a portion of steam retained by the cavities to be completely expelled by a liquid flowing towards the cavities due to the action of surface tension of the liquid, the cavities become new nucleation sites again. New vapor bubbles grow from the new nucleation sites so that the boiling process constantly continues. Therefore, it is critical to form many nucleation sites on the heating surface in order to enhance the heat transfer of the nucleate boiling.

Since 1970s, many developments for the enhancement of the performance of boiling heat transfer surfaces have been carried out based on formation of porous structure on the heating surface, which can be found from a lot of references. For example, Chinese Patents Nos. 2257376Y and 2662187Y disclose a heat transfer tube for an evaporator, of which an outer surface is formed with helical fins with tops pressed in a T shape so as to constitute channel structure; Chinese Patents Nos. CN1090759C and CN2557913Y disclose a heat transfer tube, of which an outer surface is formed with helical fins with inclined teeth uniformly arranged circumferentially, and a cavity structure is formed by pressing the fins so that tops of the fins extend towards both sides thereof; China Application Publication No. 1366170A discloses a heat transfer tube, of which an outer surface is formed with fins by machining, and secondary channels are formed at bottoms of primary channels between the fins; Chinese Patent No. 1100517A discloses a heat transfer tube, in which fins on an outer surface of the heat transfer tube are pressed to be inclined towards one side, and then notches are impressed into the shoulder of the fins in order to constitute a cavity structure on the outer surface of the heat transfer tube; Chinese Patent No. 2572324Y discloses a heat transfer tube for an evaporator, of which an outer surface is formed with helical fins with sawtooth shape, and then inclined notches are impressed into tops of sawtooth in order to manufacture a cavity structure on the outer surface of the heat transfer tube. The outer wall surfaces, which are also called outer fin structure, of the heat transfer tubes disclosed in the above references have a common structural feature that the heat transfer tubes are disposed with channels or cavities with slightly small openings to constitute nucleation sites for evaporating, so as to enhance the boiling heat transfer. With the further study on the mechanism of the nucleate boiling, however, it has been found that after the vapor bubbles are formed, evaporation of liquid micro layers between the wall and the bottoms of the vapor bubbles plays an important role and even a dominant role in the growing process of the vapor bubbles. The experiment on the boiling heat transfer in a lower liquid level shows that after the liquid level is lower than a critical value which is less than two times the diameter of a vapor bubble, when a previous vapor bubble escapes the heat surface to ascend, it can not immediately break away from the heating surface since it is subject to the suppression of a liquid surface. When a next vapor bubble grows, it is oppressed by the previous vapor bubble so as to grow in hemisphere shape. Therefore, a liquid micro layer below the vapor bubble has a large evaporating area, thereby significantly improving boiling heat transfer coefficient. It was demonstrated from the experiment that since a liquid micro layer below the vapor bubble has a thickness of the order of magnitude of about 1 micrometer, so that it has a much small thermal resistance. If the area of the liquid micro layer of the vapor bubble bottom is enlarged or the duration of the liquid micro layer of the vapor bubble bottom is prolonged, the boiling heat transfer will be enhanced.

However, in the disclosed references, the fins on the outer wall surfaces of the heat transfer tubes for evaporators can not achieve such an effect which improves the boiling heat transfer coefficient and boiling heat transfer significantly, as has been demonstrated by the above experiment. Moreover, the heat transfer tubes are heavy in weight, thereby wasting raw material.

SUMMARY OF THE INVENTION

It is an object of the present invention to provide a heat transfer tube for an evaporator which can significantly improve the boiling heat transfer coefficient and the boiling heat transfer between an outer surface of the heat transfer tube and a liquid outside the heat transfer tube, with the weight of the transfer tube being reduced.

In accordance with one aspect of the present invention, a heat transfer tube for an evaporator, comprising: a tube body; outer fins extending on an outer wall surface of the tube body and having opposite outer fin walls between tow adjacent fins; channels located between the adjacent fins so as to constitute channel chambers; fin top platforms on respective tops of the outer fins, the fin top platforms including fin top edges which extend from both sides of the fin top platforms so that the channel chambers take a form of a cavity structure as a whole; channel chamber openings constituted by gaps between the adjacent fin top edges of the fin top platforms of the outer fins; and lateral fins arranged on portions or substantially middle portions of the outer fin walls of the outer fins in a height direction of the outer fins and arranged at intervals in the spreading direction of the outer fins, so that the cavity structure is form into a double cavity structure.

The object of the present application is achieved by providing a heat transfer tube for an evaporator, comprising: a tube body, outer fins extending on an outer wall surface of the tube body and having fin top platforms on tops of the outer fins, and channels located between the adjacent outer fins. Fin top edges extend laterally from both sides of the fin top platforms. The fin top edges approach the fin top edges extending laterally from both sides of the fin top platforms of the adjacent outer fins, in such a manner that each of openings of channel chambers of the channels is closed with a gap formed between the fin top edges of the adjacent outer fins, and that the channel chambers take a form of a cavity structure. Lateral fins or lateral protrusions arranged at intervals on outer fin walls of the outer fins in the spreading direction of the outer fins and at substantially middle portions of the outer fins in a height direction of the outer fins, so that the cavity structure has the form of double cavity structure.

Each of the outer fins according to the present invention spreads on the outer wall surface of the tube body helically, annularly, or in an axial direction of the tube body, and the outer fins have a fin height of 0.4 mm to 1.6 mm and a fin pitch of 0.4 mm to 1.5 mm.

The fin top platforms of the outer fins according to present invention have a T shape. In accordance with another aspect of the present invention, inclined notches are disposed on the outer fins, the inclined notches having a depth in a range from 0.1 mm to 0.5 mm, the bottoms of the inclined notches locating above or higher than roots of the lateral fins, and the number of the inclined notches per centimeter in the spreading direction of the outer fins being 10 to 25, the inclined notches being positioned at an angle $\alpha$ in a range of 40° to 50° relative to the spreading direction of the outer fins, and the fin top platforms being shaped by the inclined notches into tooth platforms, the tooth platforms and the lateral fins being disposed in a staggered arrangement. Tooth top inclined grooves are formed on top surfaces of the tooth platforms, the tooth top inclined grooves having a depth in a range of 0.05 mm to 0.25 mm, and being arranged at an angle $\beta$ in a range of 130° to 140° relative to the spreading direction of the outer fins.

In accordance with another aspect of the present invention, the lateral fins extend from the portions or the substantially middle portions of the outer fins in such a manner that a surface of each of the lateral fins facing the fin top platforms is a plane and parallel to the outer wall surface of the tube body.

In accordance with another aspect of the present invention, the lateral fins extend from the portions or the substantially middle portions of the outer fins in such a manner that a surface of each of the lateral fins facing the fin top platforms and the corresponding outer fin intersect at an acute angle and that each of the lateral fins bends away from the corresponding outer fin.

In accordance with another aspect of the present invention, the number of the lateral fins per centimeter in the spreading direction of the outer fins on each of the outer fin walls is 10 to 25, each of the lateral fins having a top, a ratio of a distance between a center of the top and a corresponding bottom of the channel to a fin height of the outer fins is 0.2 to 0.75, the lateral fins having a width which is greater than or equal to 0.2 mm, and a ratio of the width of the lateral fins to a lateral fin pitch in the spreading direction of the outer fins is less than or equal to 0.8.

In accordance with further aspect of the present invention, inner fins are disposed helically on an inner wall surface of the tube body, the inner fins having a height of 0.3 to 0.5 mm and being arranged at an angle $\gamma$ of 40° to 50° relative to an axis of the tube body.

In accordance with an aspect of the present invention, the lateral fins are disposed at an equal pitch or equidistantly in the spreading direction of the outer fins and on one of the outer fin walls of each of the outer fins, the lateral fins having fin tips, the fin tips extending in such a manner that they touch the corresponding outer fin walls of the adjacent outer fins, or that a narrow gap is formed between the fin tips and the corresponding outer fin walls of the adjacent outer fins.

In accordance with another aspect of the present invention, the lateral fins are disposed at an equal pitch or equidistantly in the spreading direction of the outer fins and in pair on both of the outer fin walls of each of the outer fins, the lateral fins having fin tips, the fin tips extending in such a manner that the fin tips on the opposite outer fin walls are disposed in a staggered arrangement, touch each other, or form a narrow gap therebetween.

The present application has the advantage over the cavity structure in prior art. In the present invention the said double cavity structure is formed by laterally extending the fin top platforms at both sides thereof so that the channels are formed into a cavity structure, and further by disposing lateral fins at waists of the outer fins in the spreading direction of the outer fins. With this configuration, during boiling heat transfer, vapor bubbles generated at the bottoms of the channels grow in such a manner that they are oppressed by the lateral fins and other vapor bubbles generated above the lateral fins, so that they extend towards both sides thereof in the spreading direction of the outer fins, thereby enlarging the area of liquid micro layer below the vapor bubbles on the bottoms of the channels. With upgrowth of the vapor bubbles, the vapor bubbles will cross the lateral fins against the suppression of the lateral fins and will be combined with the other vapor bubbles above the lateral fins, so that the resultant vapor bubbles escape from the gaps between the fin top platforms to depart from the heat transfer tube. When the supper-cooling liquid are discharged rapidly into the channels after the bubbles have escaped, then the lateral fins will prevent the liquid from dashing the remaining vapor so that the cavity structure retains evaporating nucleation sites enough to continue the enhanced boiling heat transfer. Therefore, the present application provides a heat transfer tube which can achieve the technical effect of improving the boiling heat transfer coefficient and enhancing the boiling heat transfer. Moreover, since the lateral fins extend from the portions or the substantially middle portions of the outer fin walls of the outer fins between the fin top platforms and the bottoms of the channels, it is not necessary to increase the height of the outer fins in order to obtain a large area of heat transfer. Therefore, present application provides a heat transfer tube which can save material and reduce the weight of the tube body.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
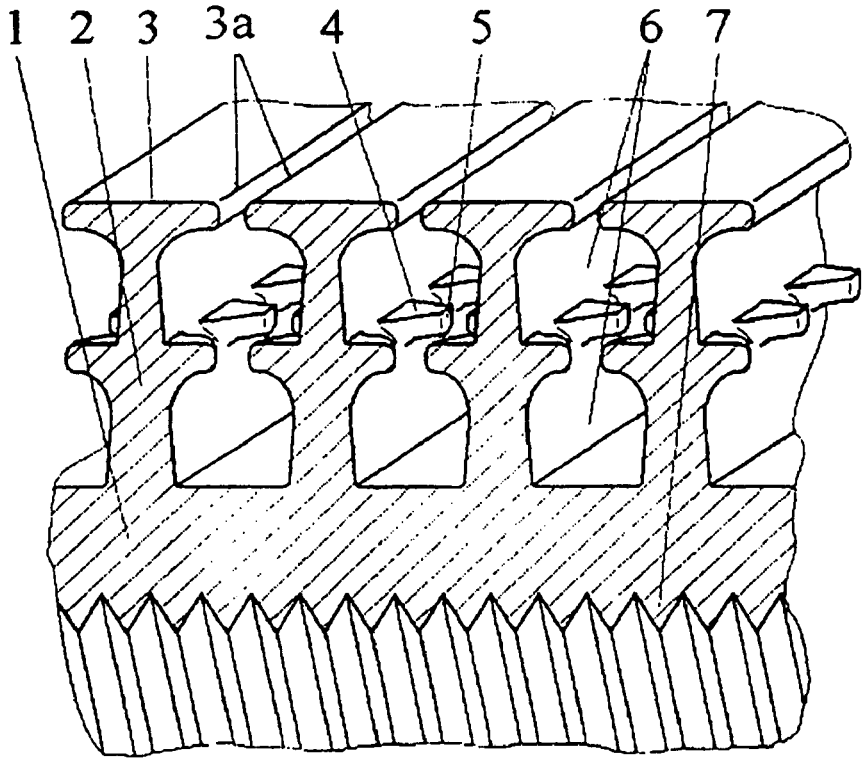
FIG. 1 is a schematic perspective view of a heat exchanger tube according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures. However, the present application is not limited to the embodiments.

Referring to FIGS. 1 to 4, outer fins 2 may spread helically around a tube body 1, or may spread annularly around the tube body 1 so as to form a plurality of annular outer fins on the tube body 1. Alternatively, the outer fins 2 may extend in an axial direction of the tube body 1 to form a plurality of straight outer fins. Among the above three types of outer fins 2, the helical fins are preferable since it is most suitable for a heat transfer tube with helical fins to be manufactured by further providing a cutter for cutting lateral fins 4 (which will be described in detail later) on the basis of the prior art.

The outer fins 2 and channels 6 constituted by the outer fins form a basis for forming a cavity structure on an outer surface of the tube body 1. The outer fins 2 have a fin height in an appropriate range and a fin pitch in an appropriate range. If values of the fin height and the fin pitch are excessively small, the number of nucleation sites is greatly increased, but a radius of the nucleation sites formed by further manufacturing will become small. The superheat temperature required for boiling is thus raised, which is adverse to the nucleate boiling heat transfer. However, if the values of the fin height and the fin pitch are excessively large, although the radius of the nucleation sites become great, the number of nucleation sites will be decreased, which also degrades the nucleate boiling heat transfer. In view of the above, the fin height is in the range from 0.4 mm to 1.6 mm and the fin pitch is in the range from 0.4 mm to 1.5 mm in an embodiment of the present application.

Figure 2:
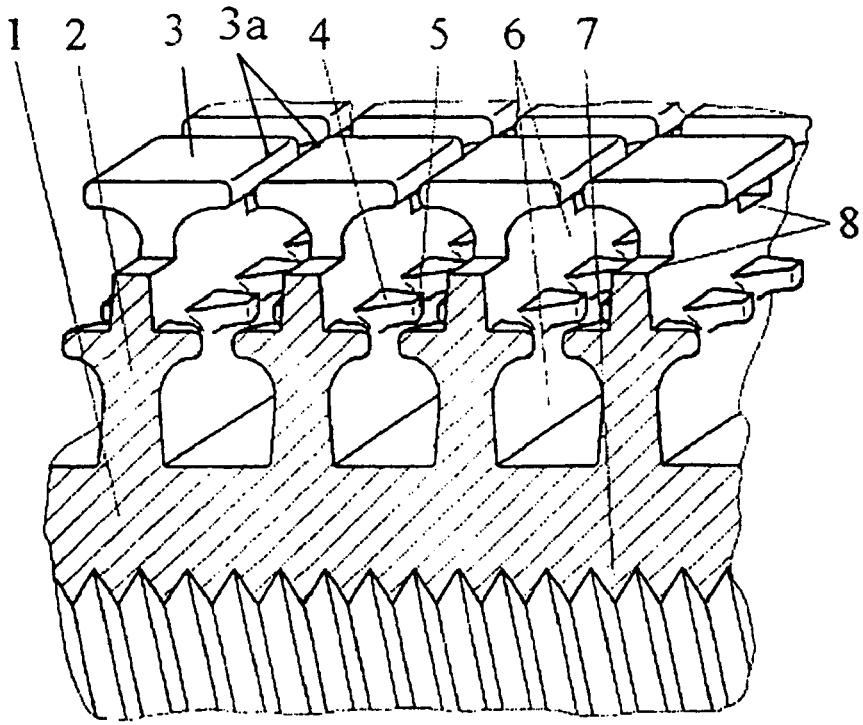
FIG. 2 is a schematic perspective view of a heat exchanger tube according to another embodiment of the present invention.
Figure 3:
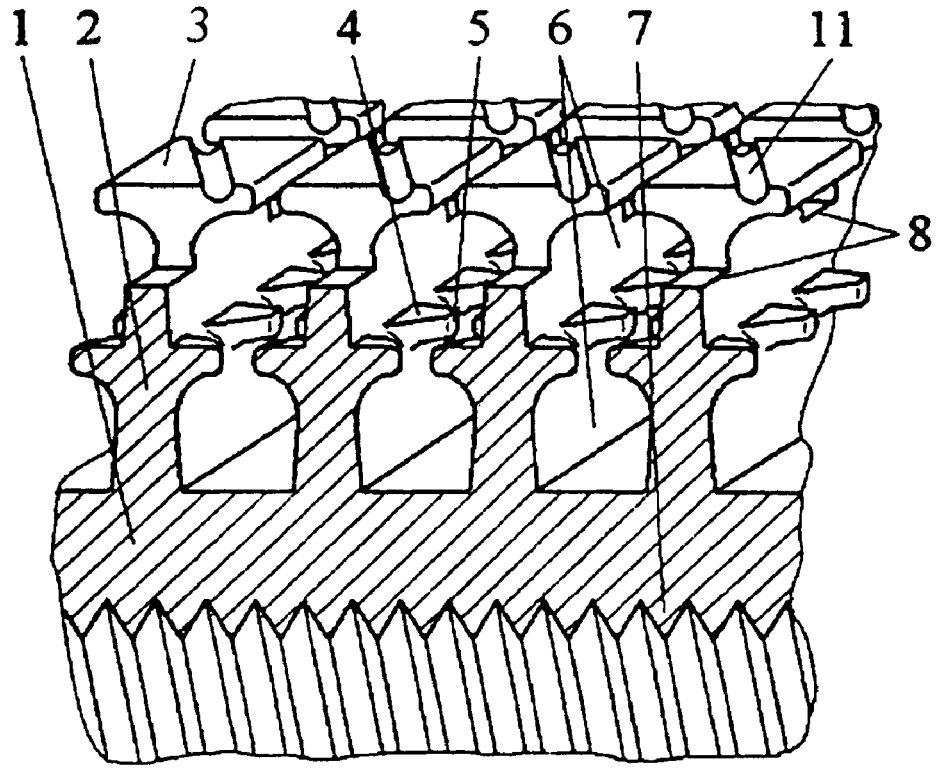
FIG. 3 is a schematic perspective view of a heat exchanger tube according to a further embodiment of the present invention.
Figure 4:
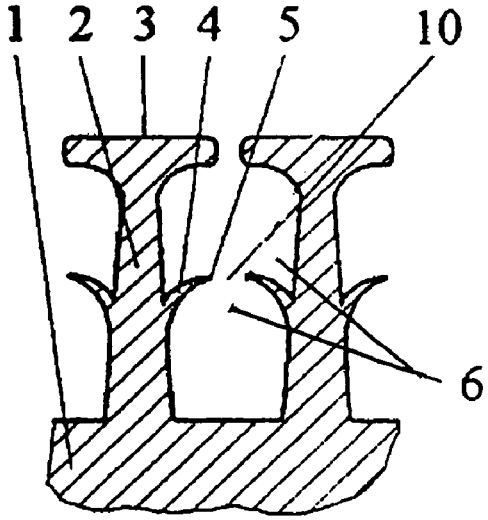
FIG. 4 is a schematic sectional view of lateral fins 4 according to an embodiment of the present invention.
Figure 5:
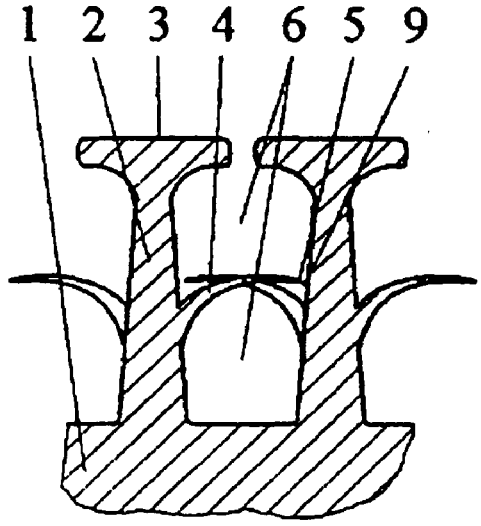
FIG. 5 is a schematic sectional view of lateral fins 4 according to another embodiment of the present invention.
Figure 6:
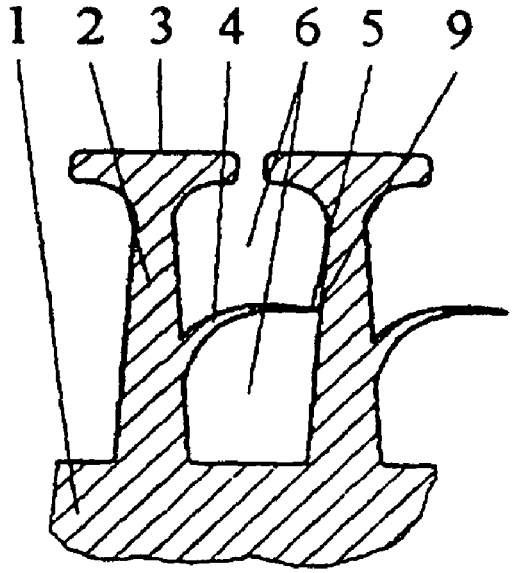
FIG. 6 is a schematic sectional view of lateral fins 4 according to a further embodiment of the present invention.

Referring to FIGS. 1 through 4, after the outer fins are formed, lateral fins 4 may be manufactured at approximately middle portions of the outer fins 2 in a height direction of the outer fins 2, or more particularly at waists of the outer fins 2 by a cutter different from that used for forming the outer fins 2. A surface of each of the lateral fins 4 which faces fin top platforms 3 of the outer fins 2 is a plane and is parallel to the outer surface of the tube body 1. The lateral fins as shown in FIG. 4 may be cut from the outer fin 2 by a sharp cutter in such a manner that the surface of each of the lateral fins 4 facing the fin top platforms 3 and the said outer fin 2 intersect at an acute angle and that each of the lateral fins 4 slightly bends away from the said outer fin 2. The lateral fins 4 easily withhold remaining gas in the acute angle portions at roots of the lateral fins 4 so as to form additional nucleation sites. Referring to FIGS. 1 through 4 in conjunction with FIGS. 5 and 6, the lateral fins 4 are arranged depending on a width of the channel 6, preferably in a manner that the lateral fins 4 on opposite fin side walls of the outer fins face each other. Specifically, the lateral fins 4 are arranged at an equal pitch or equidistantly in a spreading direction of the outer fins 2 and project from opposite positions on the side wall surfaces of the outer fins 2 on both sides of the channels 6, so that lateral fins 4 on the two opposite side wall surfaces of each of the channels 6 face each other in an one-to-one manner. The lateral fins 4 have fin tips 5. The fin tips 5 of the lateral fins 4 on one side wall surface of each of the channels 6 are brought into contact with or superposed upon the fin tips 5 of the lateral fins 4 on the other side wall surface opposite to said one side wall surface, or the fin tips 5 of the lateral fins 4 on said one side wall surface and the fin tips 5 of the lateral fins 4 on the other side wall surface form a gap 10 therebetween, so that a double cavity structure is formed in channel chambers of the channels 6. The double cavity mentioned above can be appreciated from anyone of FIGS. 1 to 6. Specifically, firstly, the fin top platforms 3 is laterally extended outwards from both sides thereof so that openings of channel chambers of the channels 6 have a narrow gap, and thus the entire channel chambers of the channels 6 are formed into cavities which tend to be closed, or are nearly closed. Secondly, the cavities are partitioned by the lateral fins 4 into double cavities each including an upper cavity and a lower cavity. When the fin pitch of the outer fins 2 is small and thus the channels 6 are narrow, the lateral fins may be arranged as shown in FIG. 5. Specifically, the lateral fins 4 are arranged at an equal pitch or equidistantly in the spreading direction of the outer fins 2, and are extended alternately from positions of the same height on the opposite side wall surfaces of the outer fins 2 on both sides of the channels 6, so that the lateral fins 4 on the two opposite sides of each of the channels 6 are disposed in a staggered arrangement. The lateral fins 4 have fin tips 5. The fin tips 5 are brought into contact with or superposed upon the corresponding side wall surfaces of the outer fins opposite the fin tips 5, or are close to the corresponding side wall surfaces with a gap 9 therebetween, so that the channels 6 are formed into a double cavity structure. If the lateral fins are arranged in a manner shown in FIG. 6, the lateral fins 4 are disposed on one of the two sides of each of the outer fins 2. Moreover, the lateral fins 4 are arranged at an equal pitch or equidistantly in the spreading direction of the outer fins 2. The lateral fins 4 have fin tips 5. The fin tips 5 touch or are superposed upon the corresponding side wall surfaces of the outer fins opposite the fin tips 5, or are close to the corresponding side wall surfaces with a narrow gap 9 therebetween, so that the channels 6 are formed into a double cavity structure.

A density of the lateral fins 4 in the spreading direction of the outer fins 2 depends on not only a width of the channels 6, but also a shape of the fin top platforms 3 of the outer fins 2. The density of the lateral fins 4 in the spreading direction of the outer fins 2 may be 10-25 fins per centimeter. In the case that the outer fins 2 are T-shaped in cross section as shown in FIG. 1, a ratio of a fin pitch of the lateral fins 4 to the width of the channels 6 is preferably 1.5-2. Furthermore, the actual ratio of the fin pitch of the lateral fins 4 to the width of the channels 6 is 1.6 in a heat transfer tube manufactured according to the present application.

Each of the channels 6 is divided into an upper portion close to the fin top platforms 3 and a lower portion close to roots of the outer fins 2. Since the wall surface of the outer fins at the upper portion of each of the channels 6 has a temperature degree of superheat slightly larger than that of the wall surface of the outer fins at the upper portion, the cavity at the upper portion of each of the channel 6 has a radius larger than that of the cavity at the lower portion. In addition, in order to facilitate coinstantaneous escape of gas bubbles from the heat transfer tube after the bubbles in both the upper portion and the lower portion of each of the channels 6 aggregate, a ratio of a height or depth of the upper portion to a height or depth of the lower portion of each of the channels 6 is preferably 1-2, so that the upper portion of each of the channels 6 can accommodate complete gas bubbles, while the lower portion can accommodate gas bubbles of a hemispherical shape. A height position of the lateral fins 4 is preferably determined in such a manner that a ratio of a distance between a center of a top of each of the lateral fins 4 and a corresponding bottom of the channel 6 to the fin height of the outer fins 2 is 0.2-0.75.

Since the lateral fins 4 are used to oppress a growing shape of the gas bubbles, but are not used to restrain the growth of the gas bubble or to cut up the gas bubble, a side surface of each of the lateral fins 4 facing the roots of the outer fins 2 should be formed into a smoothly curved surface or a smooth surface, and the fin tips 5 of the lateral fins 4 should not have a sharp shape. If the fin tips 5 are formed into a sharp shape due to the limitation of the manufacturing process, the fin tips 5 can be superposed upon the opposite fin tips 5, or upon the side wall surface of the outer fins 2 opposite the fin tips 5. For the same purpose, a width of the lateral fins 4 is determined to be larger than or equal to 0.2 mm, and a radio of the width of the lateral fins 4 to the fin pitch of the lateral fins 4 in the spreading direction of the outer fins 2 is less than or equal to 0.8. If the width is too large, the growth and ascent of the gas bubbles will be impeded. However, if the width is too narrow, the gas bubbles will be cut up rather than become flat.

After the lateral fins 4 is manufactured, the fin top platforms 3 of the outer fins 2 can be manufactured by the conventional process.

Solution 1: The fin top platforms 3 of the outer fins 2 are pressed vertically, so that the fin top platforms 3 extend to both sides thereof. As a result, the outer fins 2 are T-shaped as shown in FIG. 1.

Solution 2: A plurality of inclined notches 8 are formed in the outer fins 2, and then the fin top platforms 3 of the outer fins 2 are pressed vertically. Bottoms of the notches 8 formed in the outer fin 2 is above or higher than roots of the lateral fins 4. The fin top platforms 3 are formed into tooth platforms as shown in FIGS. 2 and 3 by adjacent inclined notches 8. The inclined notches 8 are formed not only for forming the tooth platforms, but also for forming a net-shaped channel structure with the channels 6, so as to facilitate the escape of the gas bubbles and the inflow of liquid. The inclined notches 8 are sized to have a depth of 0.1 mm to 0.5 mm, and the bottoms of the notches 8 are not lower than the roots of the lateral fins 4 to avoid damaging or cutting the lateral fins 4. In addition, the number of the inclined notches 8 per centimeter in the spreading direction of the outer fins 2 is 10-25, and the inclined notches are positioned at an angle $\alpha$ in a range of 40° to 45° relative to the spreading direction of the outer fins 2.

Preferably, a density of the lateral fins 4 in the spreading direction of the outer fins 2 is such that the number of the lateral fins 4 per centimeter in the spreading direction of the outer fins 2 is equal to the number of the tooth platforms per centimeter in the spreading direction of the outer fins 2, as show in FIGS. 2 and 3. The lateral fins 4 and the tooth platforms are disposed in a staggered arrangement when viewed form a direction perpendicular to the surface of the tube body 1 of the heat transfer tube.

Solution 3: A plurality of inclined notches 8 are formed on the outer fins 2, so that the outer fins 2 are formed in a dentate shape, and then inclined tooth top grooves 11 are formed on surfaces of the fin top platforms 3. As a result, the fin top platforms 3 are formed into tooth platforms. It is not difficult to understand that the tooth platforms are formed by pushing a material at tops of the fin top platforms 3 towards both sides of each of the inclined tooth top grooves 11. The tooth platforms are pressed vertically such that an opening size of the channels 6 is in a range as required. In the heat transfer surface as configured above, the bottoms of the inclined notches 8 are higher than or above the roots of the lateral fins 4, the inclined tooth top grooves 11 have a depth of 0.05 mm to 0.25 mm, and the inclined tooth top grooves 11 are positioned at an angle $\beta$ in a range of 130° to 140° relative to the spreading direction of the outer fins 2.

Furthermore, there are other solutions to extend or push the material of the fin top platforms 3 of the outer fins 2 towards to the both sides of the fin top platforms 3 of the outer fins 2, so that the channel concavities of the channels 6 are formed into concavity structures in the other forms. Therefore, It should be appreciated that variations and modification to the described embodiments are possible and would fall within the scope of the present invention.

Figure 7:
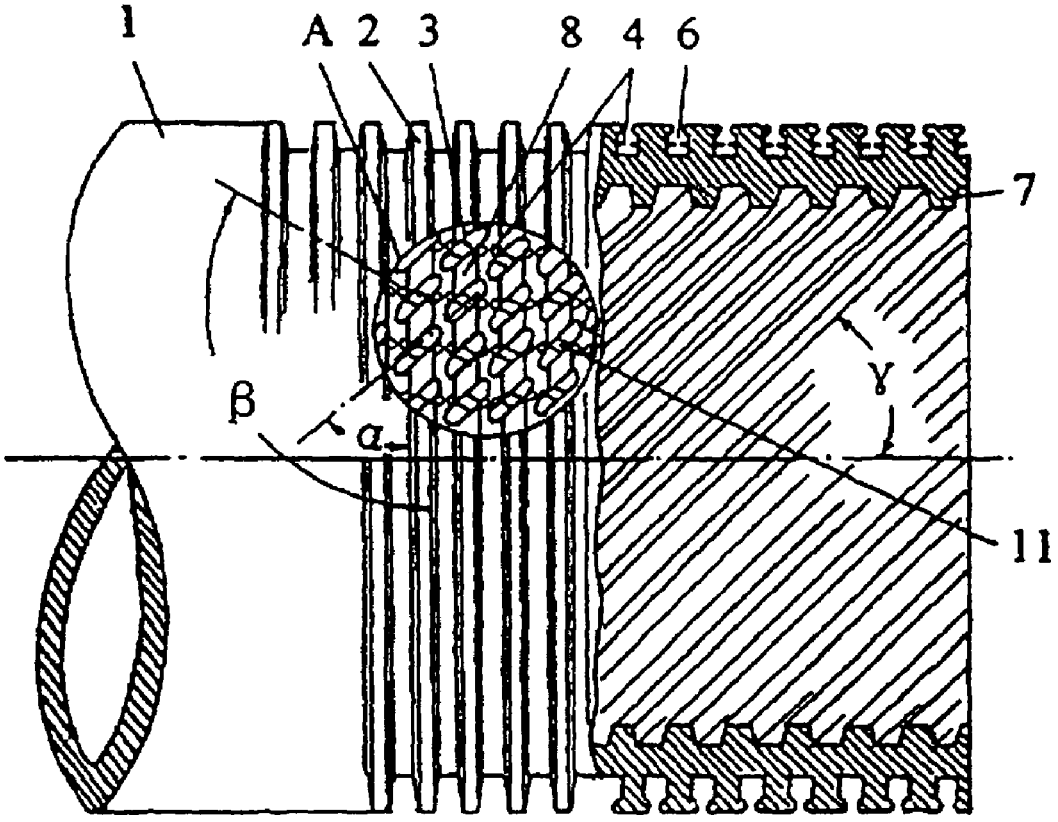
FIG. 7 is a schematic perspective view of a heat exchanger tube according to an embodiment of the present invention showing the overall structure of a heat exchanger tube.

While enhancing a boiling heat transfer outside the tube, it is necessarily to increase a forcible convection heat transfer inside the tube. Since a two-phase heat transfer occurs outside the tube, when a single phase convective heat transfer is performed inside the tube, a thermal resistance inside the tube is usually larger than or corresponds to that outside the tube. Only when the convection heat transfer coefficient inside the tube is increased by an enhanced heat transfer technique, the total heat transfer effect can be improved. Therefore, if inter fins 7 are disposed in the tube body 1, the boiling heat transfer system and enhanced boiling heat transfer effect mentioned above will be further improved, since the inner fins contribute to the improvement of the convective heat transfer coefficient inside the tube body 1. The inner fins 7 shown in FIGS. 1 through 3 are triangular in cross section, while the inner fins shown in FIG. 7 are trapeziform in cross section. Furthermore, the inner fins 7 may have the other shapes in cross section. Therefore, the shapes of the inner fins are not limited to those disclosed in the specification. The common characteristic of the inner fins 7 is that the inner fins 7 are helical, the inner fins 7 are preferably arranged at a helical angle $\gamma$ of 40° to 50° relative to an axis of the tube body 1, and have a height of 0.3 to 0.5 mm.

Figure 9:
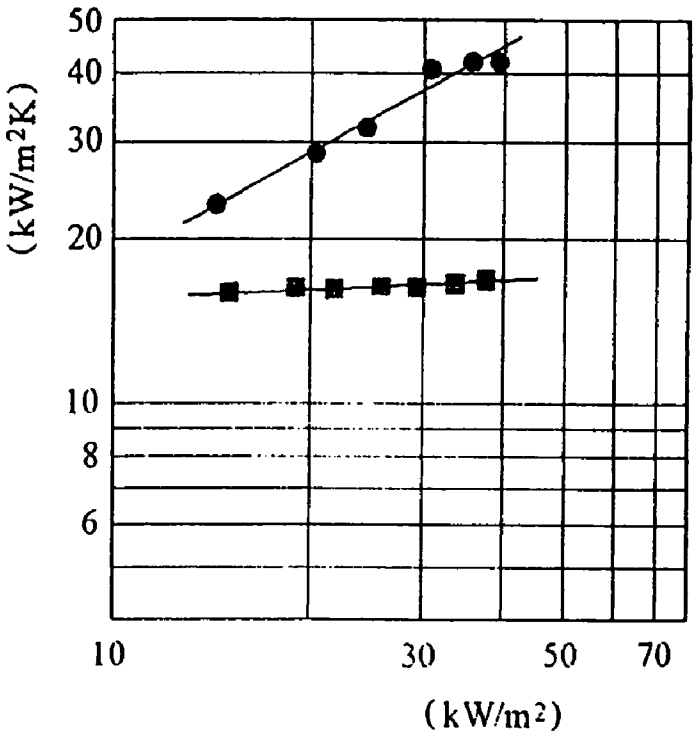
FIG. 9 is a graph comparing the relationship of the boiling heat transfer coefficient for boiling outside a heat transfer tube to the heat flux for a heat transfer tube according to present application with that for a prior art heat transfer tube.
Figure 8:
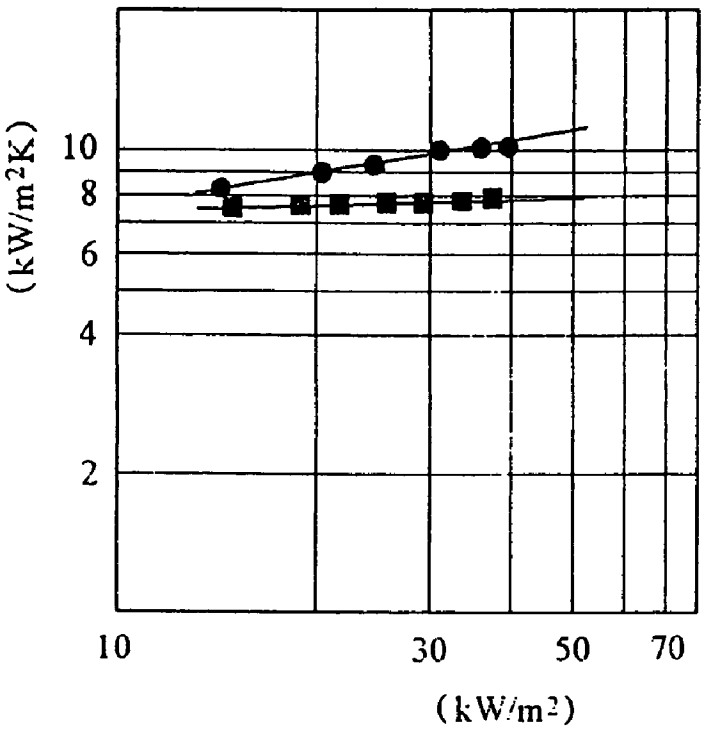
FIG. 8 is a graph comparing the relationship of the overall heat transfer coefficient to the heat flux for a heat transfer tube according to present application with that for a prior art heat transfer tube.

The test results on the boiling heat transfer performance of the heat transfer tube configured according to the present application are shown in FIGS. 8 and 9. The dimensions of the tube are as follows:

Outer fins 2 of a tube body 1 are helical; an outer diameter of the tube body 1 (that is, an outer diameter including fin top platforms 3) is 18.89 mm; a fin height of the outer fins 2 is 0.62 mm and a fin pitch of the outer fins 2 is 0.522 mm; a depth of inclined notches 8 is 0.18 mm, the inclined notches 8 are positioned at an angle $\alpha$ of 45° relative to an spreading direction of the outer fins 2, and the number of the inclined notches 8 per centimeter in a circumferential direction of the tube body 1 is 17; a depth of inclined tooth top grooves 11 is 0.08 mm, and the inclined tooth top grooves 11 are positioned at an angle $\beta$ of 135° relative to the spreading direction of the outer fins 2; a width of lateral fins 4 is 0.4 mm, a height of the lateral fins 4 from bottoms of the channels 6 is 0.32 mm, and the number of the lateral fins 4 per centimeter in the circumferential direction of the tube body 1 is 19; inner fins 7 are trapeziform in cross section, a fin height of the inner fins 7 is 0.36 mm, a fin pitch of the inner fins 7 was 1.14 mm, and the inner fins 7 are arranged at a helical angle γ of 45° relative to an axis or central line of the tube body 1.

For comparison purposes, another prior art heat transfer tube without the lateral fins 4 are tested.

FIG. 8 shows the test results of the overall heat transfer coefficients of the heat transfer tube configured according to the present application and the prior art heat transfer tube for comparison. In the test, a refrigerant was R22, a saturation temperature of which was 14.4° C., a flow rate of water inside the tube body 1 was 1.6 m/s. In FIG. 8, the horizontal coordinate represents a heat flux ($kW/m^2$), while the vertical ordinate represents an overall heat transfer coefficient ($kW/m^2K$). In addition, the solid circles indicate the test data of the heat transfer tube according to the present invention, and the solid blocks indicate those of the prior art heat transfer tube.

FIG. 9 shows the test results of the boiling heat transfer coefficients outside the teat transfer tube configured according to the present application and the conventional heat transfer tube for comparison. In the test, a refrigerant is R22, a saturation temperature of which is 14.4° C., a flow rate of water insider the tube body 1 is 1.6 m/s. In FIG. 9, the horizontal coordinate represents a heat flux ($kW/m^2$), while the vertical ordinate represents a boiling heat transfer coefficient ($kW/m^2K$) outside the tube. In addition, the solid circles indicate the test data of the heat transfer tube according to the present invention, and the solid blocks indicate those of the prior art heat transfer tube.

It could be seen from FIGS. 8-9 that because the lateral fins 4 are provided, the heat transfer performance of the heat transfer tube configured according to the present application is considerably improved as compared with the prior art.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A heat transfer tube for an evaporator, comprising:

a tube body;

a plurality of outer fins extending on an outer wall surface of the tube body and having outer fin walls opposite to the outer fin walls of any adjacent outer fin;

a channel located between adjacent fins so as to constitute a channel chamber;

a fin top platform on each of the respective tops of the outer fins, the fin top platform including fin top edges which extend from both sides of the fin top platform so that the channel chambers located between adjacent fins form a cavity structure as a whole;

each channel chamber having openings constituted by gaps between the adjacent fin top edges of the fin top platforms of the outer fins; and a lateral fin arranged on a portion or a substantially middle portion of each of the outer fin walls of the outer fins in a height direction of the outer fins and at intervals in a spreading direction of the outer fins so that the cavity structure is formed into a double cavity structure.

2. The heat transfer tube according to claim 1, wherein each of the outer fins spreads on the outer wall surface of the tube body helically, annularly, or in an axial direction of the tube body, and having a fin height of 0.4 mm to 1.6 mm and a fin pitch of 0.4 mm to 1.5 mm.

3. The heat transfer tube according to claim 2, wherein the fin top platforms of the outer fins have a T-shape.

4. The heat transfer tube according to claim 2, wherein inclined notches are disposed on the outer fins, the inclined notches including bottoms above or higher than roots of the later fins and having a depth in a range of 0.1 mm to 0.5 mm, the number of the inclined notches per centimeter in the spreading direction of the outer fins being 20 to 25, inclined notches being positioned at angle α in a range of 40° to 50° relative to the spreading direction of the outer fins, and the fin top platforms being shaped by the inclined notices into tooth platforms, the tooth platforms and the lateral fins being disposed in a staggered arrangement, inclined tooth top grooves are formed on top surfaces of the tooth platforms, the inclined tooth top grooves having a depth in a range of 0.05 mm to 0.25 mm, and being arranged at an angle β in a range of 130° to 140° relative to the spreading direction of the outer fins.

5. The heat transfer tube according to claim 1, wherein the fin top platforms of the outer fins have a T-shape.

6. The heat transfer tube according to claim 1, wherein inclined notches are disposed on the outer fins, the inclined notches including bottoms above or higher than roots of the lateral fins and having a depth in a range from 0.1 mm to 0.5 mm, the number of the inclined notches per centimeter in the spreading direction of the outer fins being 10 to 25, the inclined notches being positioned at an angle α in a range of 40° to 50° relative to the spreading direction of the outer fins, and the fin top platforms being shaped by the inclined notches into tooth platforms, the tooth platforms and the lateral fins being disposed in a staggered arrangement, inclined tooth top grooves are formed on top surfaces of the tooth platforms, the inclined tooth top grooves having a depth in a range of 0.05 mm to 0.25 mm, and being arranged at an angle β in a range of 130° to 140° relative to the spreading direction of the outer fins.

7. The heat transfer tube according to claim 1, wherein the lateral fin extends from the portion or the substantially middle portion of an outer fin in such a manner that a surface of each of the lateral fins facing the fin top platforms is a plane and is parallel to the outer wall surface of the tube body.

8. The heat transfer tube according to claim 7, wherein the number of the lateral fins per centimeter in the spreading direction of the outer fins on each of the outer fin walls is 10 to 25, each of the lateral fins having a top, a ratio of a distance between a center of the top and a corresponding bottom of the channel to a fin height of the outer fins is 0.2 to 0.75, the lateral fins have a width grater than or equal to 0.2 mm, and a ratio of the width of the lateral fins to a fin pitch of the lateral fins in the spreading direction of the outer fins ins less than or equal to 0.8.

9. The heat transfer tube according to claim 1, wherein the number of the lateral fins per centimeter in the spreading direction of the outer fins on each of the outer fin walls is 10 to 25, each of the lateral fins having a top, a ratio of a distance between a center of the top and a corresponding bottom of the channel to a fin height of the outer fins to 0.2 to 0.75, the lateral fins have a width greater than or equal to 0.2 mm, and ratio of the width of the lateral fins to a fin pitch of the lateral fins in the spreading direction of the outer fins is less than or equal to 0.8.

10. The heat transfer tube according to claim 9, wherein the lateral fins are disposed at an equal pitch or equidistantly in the spreading direction of the outer fins and on one of the outer fin walls of each of the outer fins, the lateral fins having fin tips, the fin tips extending in such a manner that they touch the corresponding outer fins walls of the adjacent outer fins, or that a narrow gap is formed between the fin tips and the corresponding outer fin walls of the outer fins.

11. The heat transfer tube according to claim 9, wherein the lateral fins are disposed at an equal pitch or equidistantly in the spreading direction of the outer fins and in pair on both of the outer fin walls of each of the outer fins, the lateral fins having fin tips, the fin tips extending in such a manner that the fin tips on the opposite outer fin walls are disposed in a staggered arrangement, touch each other, or form a narrow gap therebetween.

12. The heat transfer tube according to claim 1, wherein each inner fin is disposed helically on an inner wall surface of the tube body, the inner fin having a height of 0.3 to 0.5 mm and being arranged at an angle γ of 40° to 50° relative to an axis of the tube body.

13. The heat transfer tube according to claim 1, wherein the number of the lateral fins per centimeter in the spreading direction of the outer fins on each of the outer fin walls is 10 to 25, each of the lateral fins having a top, ratio of a distance between a center of the top and a corresponding bottom of the channel to a fin height of the outer fins is 0.2 to 0.75, the lateral fins have a width greater than or equal to 0.2 mm, and ratio of the width of the lateral fins to a fin pitch of the lateral fins in the spreading direction of the outer fins is less than or equal to 0.8.

* * * * *

US007789127C1

(12) INTER PARTES REEXAMINATION CERTIFICATE (718th)

United States Patent

Lu et al.

(10) Number: US 7,789,127 C1

(45) Certificate Issued: Oct. 28, 2013

(54) HEAT TRANSFER TUBES FOR EVAPORATORS

(75) Inventors: Minghua Lu, Changshu (CN); Chunming Zhang, Chnagshu (CN); Siaoyu Cui, Shanghai (CN); Xing Luo, Shanghai (CN); Hugen Ma, Shanghai (CN)

(73) Assignee: Jiangsu Cuilong Precision Copper Tube Corporation, Xinzhuang Town, Changshu, Jiangsu Province (CN)

Reexamination Request:
No. 95/001,840, Dec. 7, 2011

Reexamination Certificate for:

| | |
|---|---|
| Patent No.: | **7,789,127** |
| Issued: | **Sep. 7, 2010** |
| Appl. No.: | **11/429,710** |
| Filed: | **May 8, 2006** |

(30) Foreign Application Priority Data

Aug. 9, 2005 (CN) ..... 2005 1 0041468

(51) Int. Cl.
*F28F 13/18* (2006.01)
*F28F 1/20* (2006.01)

(52) U.S. Cl.
USPC ..... 165/133; 165/181; 165/184; 29/890.053

(58) Field of Classification Search
None
See application file for complete search history.

(56) References Cited

To view the complete listing of prior art documents cited during the proceeding for Reexamination Control Number 95/001,840, please refer to the USPTO's public Patent Application Information Retrieval (PAIR) system under the Display References tab.

*Primary Examiner* — David O. Reip

(57) ABSTRACT

Heat transfer tubes for evaporators in air conditioning and refrigeration systems, each tube including: a tube body (1); outer fins (2) extending on an outer wall surface of the tube body (1) and having outer fin walls opposite to the outer fin walls of the adjacent outer fins; channels (6) located between the adjacent fins (2) so as to constitute channel chambers; fin top platforms (3) on respective tops of the outer fins (2), the fin top platforms (3) including fin top edges (3a) extending from both sides of the fin top platforms (3) so that the channel chambers form a cavity structure as a whole; channel chamber openings constituted by gaps between the adjacent fin top edges (3a) of the fin top platforms (3) of the outer fins; and lateral fins (4) arranged on portions or substantially middle portions of the outer fin walls of the outer fins (2) in a height direction of the outer fins (2) and at intervals in an spreading direction of the outer fins (2), so that the cavity structure is formed into a double cavity structure.

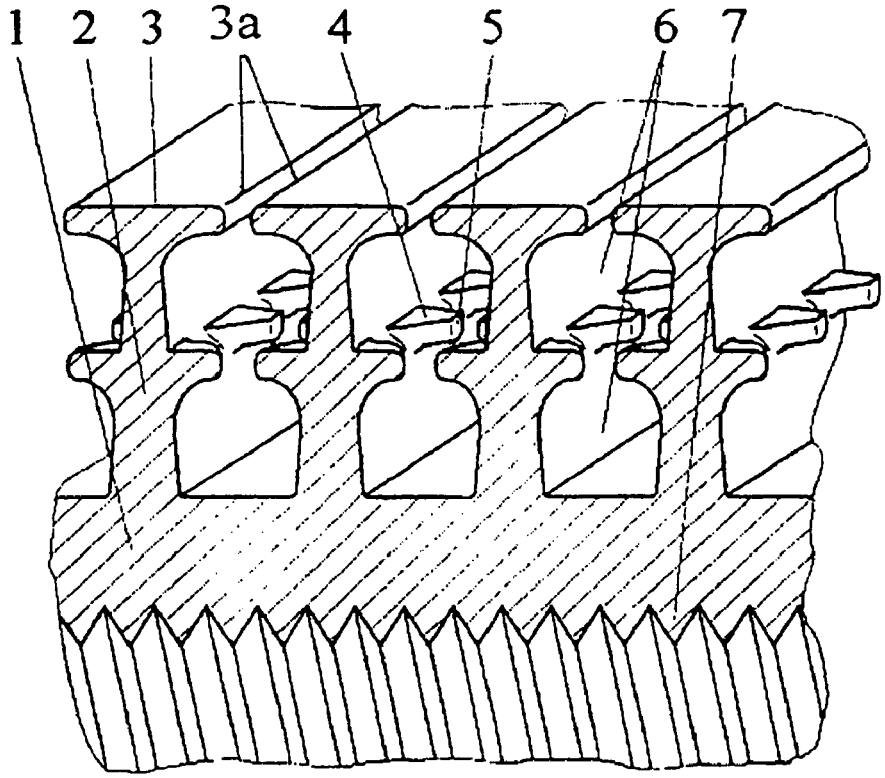

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-7, 12 and 13 are cancelled.

Claims 8-11 were not reexamined.

* * * * *